United States Patent [19]

Brown

[11] 4,219,978

[45] Sep. 2, 1980

[54] PRE-CAST REINFORCED CONCRETE BUILDING PANEL WALL STRUCTURE

[76] Inventor: Billy R. Brown, 12000 Barracks Rd., Louisville, Ky. 40219

[21] Appl. No.: 930,495

[22] Filed: Aug. 3, 1978

[51] Int. Cl.[2] ..... E04G 21/00; E04B 1/38

[52] U.S. Cl. ..... 52/125; 52/274; 52/745; 52/286

[58] Field of Search ..... 52/125, 270, 271, 274, 52/234, 284, 286, 288, 295, 459, 460, 465, 584, 596, 600, 605, 745, 747, 309.7

[56] References Cited

U.S. PATENT DOCUMENTS

| | | | |
|---|---|---|---|
| 2,351,856 | 6/1944 | Henderson | 52/125 X |
| 2,883,852 | 4/1959 | Midby | 52/274 X |
| 3,372,519 | 3/1968 | Russell | 52/274 |
| 3,394,523 | 7/1968 | Sackett | 52/584 |
| 3,435,567 | 4/1969 | Tyson | 52/125 |
| 3,449,879 | 6/1969 | Bloom | 52/309.7 |
| 3,706,168 | 12/1972 | Pilish | 52/234 |
| 3,719,016 | 3/1973 | Randolph | 52/271 X |
| 3,760,540 | 9/1973 | Latoria et al. | 52/125 |
| 3,782,057 | 1/1974 | Gross | 52/27 |
| 3,826,051 | 7/1974 | Miller et al. | 52/274 X |
| 3,828,502 | 8/1974 | Carlsson | 52/125 X |

FOREIGN PATENT DOCUMENTS

| | | | |
|---|---|---|---|
| 759688 | 5/1967 | Canada | 52/274 |
| 1289497 | 9/1972 | United Kingdom | 52/125 |

*Primary Examiner*—J. Karl Bell

*Attorney, Agent, or Firm*—Price and Caslin

[57] ABSTRACT

A wall structure formed of pre-cast reinforced concrete building panels which are each supported and sealed along their bottom edge in a self-aligning groove or channel in a supporting structure and are interlocked and sealed with each other along their vertical butting edges. Bridging members extending along the top edge of the panels tie adjacent panels together. Integral stud members extend from the top edge for lifting and fastening purposes. Some of the panels may be furnished with window frames, door frames and electrical wiring and plumbing components that are integral therewith.

11 Claims, 10 Drawing Figures

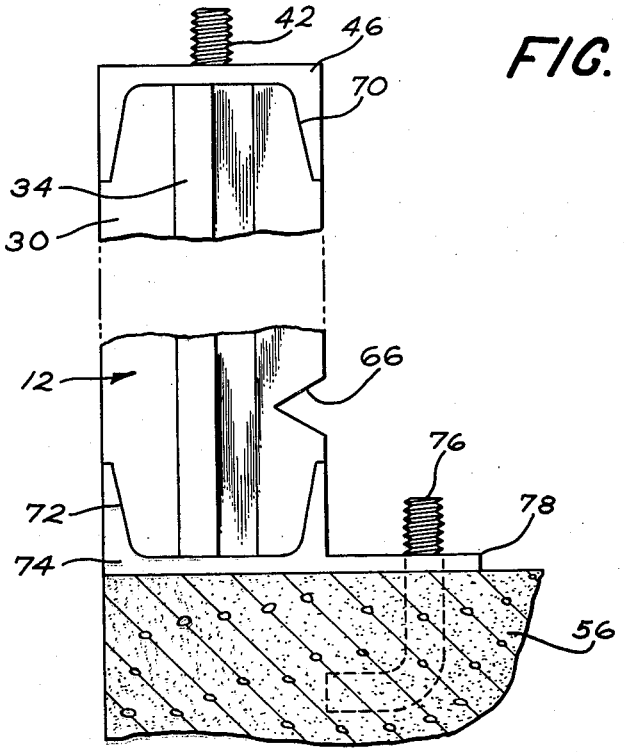
FIG. 5
FIG. 6
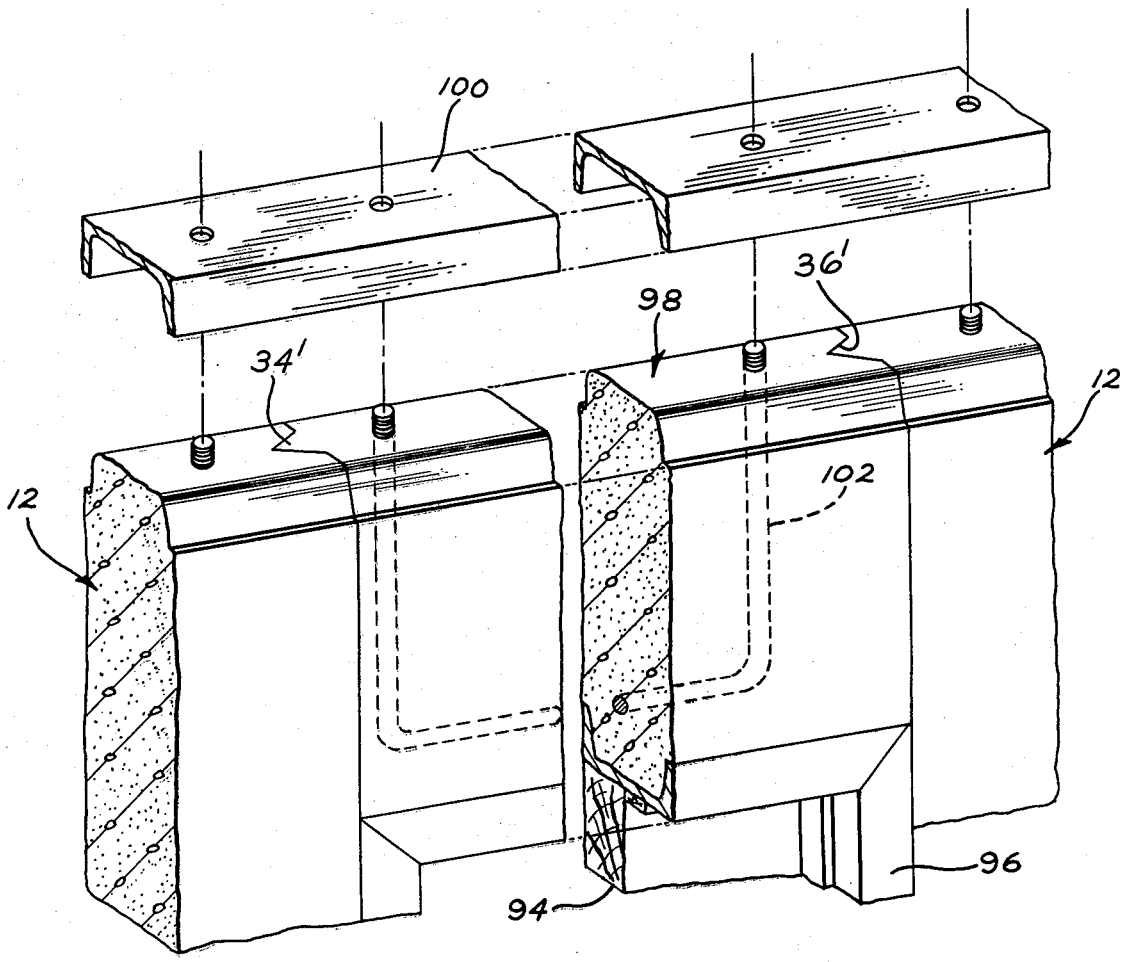

PRE-CAST REINFORCED CONCRETE BUILDING PANEL WALL STRUCTURE

BACKGROUND OF THE INVENTION

1. Field of the Invention

This invention relates to large pre-cast reinforced concrete building panels which may be aligned and joined together to form a load bearing wall without additional framing.

2. Description of the Prior Art

It is old and well known in the building industry to use large pre-cast reinforced concrete building panels to form load bearing walls.

The Tyson U.S. Pat. No. 3,435,567 shows reinforced concrete slabs or panels used in the construction of basement walls for buildings. The panels are of large size such as seven feet wide by ten feet high, and they include a series of vertically extending passageways that are employed for insulating purposes. A three-dimensional lattice work of steel reinforcing rods is molded into the concrete panel, and it has a plurality of vertical threaded studs which project from the top edge of the panel and are used for attaching a lifting device for hoisting the panel into position while constructing the building wall. These panels are joined together at the vertical sides by a mating tongue and groove connection. An angular corner piece is shown having either a tongue or a groove in its vertical side edges for mating with adjacent panels.

The Latoria et al U.S. Pat. No. 3,760,540 relates to a pre-cast concrete building panel for use in a load bearing wall without additional framing. The panel has a continuous peripheral metal channel frame, with the frame serving as the form for the concrete. A layer of insulation material, such as foamed polystyrene, is embedded in and fills the central portion of the concrete mass. Upper and lower shear bars are included in the panel. A wide fabric reinforcement, formed of much lighter elements than the shear bars, is embedded in one face of the concrete mass. These panels may be provided with a wide variety of surface finishes. A large removable eyebolt extends upwardly from the top edge of the peripheral frame for ease in handling the panels. The width of the panel may vary from 2 to 6 feet while the height may vary from 8 to 14 feet depending upon the height of the building. At the job site, the panels are erected in side-by-side relation and are welded to each other to form a completed wall structure.

The Gross U.S. Pat. No. 3,782,057 discloses a concrete balcony structure in which the front edge portion is clad with a channel-shaped metal frame. Metal securement rods are embedded in the concrete, and welded to the metal frame. They each have an external threaded stud to which the guard rail is secured.

The Bloom U.S. Pat. No. 3,449,879 discloses laminated building panels comprising a cast gypsum panel having bonded thereto an intermediate layer of foamed organic polymer and an outer layer of weathering material such as asbestos cement. The vertical side edges of the panel are provided with a tongue and groove connection with the adjacent panel. Vertical steel reinforcing tubes extend through the panel and they are each provided with fastening bolts at each end for joining the panel to the footing at the lower end, and to the ceiling at the upper end.

The Carlson U.S. Pat. No. 3,828,502 discloses a modular building system including a plurality of upright panels arranged in edge butting relationship that are joined with an interlocking fastener. The panel is made of sheet metal that is filled with an insulating core material to form a monolithic construction.

The Midby U.S. Pat. No. 2,883,852 discloses a prefabricated masonry building formed by a plurality of precast reinforced concrete building panels which are aligned by steel channel bars fitting across the top and bottom edges of the panels. Vertical locking rods are sandwiched between adjacent panels for clamping the panels between the top and bottom channel bars. The mating or butting surfaces are treated with an asphalt mastic or tar for water-proofing purposes.

The Russell U.S. Pat. No. 3,372,519 discloses a building construction formed of a plurality of abutting cast building panels and a series of horizontal roof panels with a plurality of locking plates being secured to reinforcing rods extending through the roof panels and tie rods extending through the wall panels.

The Sackett U.S. Pat. No. 3,394,523 discloses a building enclosure formed of pre-cast reinforced concrete panels, each having a peripheral frame and a lightweight panel framing that includes a web of woven wire. The gaps between adjacent panels are filled with caulking and the panels are tack welded together.

The Miller et al U.S. Pat. No. 3,826,051 discloses a reinforced wall member of generally slab-like configuration formed of a foamed polymer dispersed throughout a cementitious matrix between a pair of side panels. The bottom edge of the panels are inserted into grooves formed in the concrete floor slab. A putty or other type of cementitious mix is used in the grooves to seal the bottom of the panels in place.

OBJECTS OF THE PRESENT INVENTION

The principal object of the present invention is to provide a wall structure formed of pre-cast reinforced concrete building panels which are simple in design and handling as well as being reliable in operation and weatherproof.

A further object of the present invention is to provide a wall structure of the class described wherein the building panels are supported in precision-formed grooves in the top of the footings of the building foundation.

A further object of the present invention is to provide a wall structure of the class described wherein the panel reinforcement includes vertical stud members at the top of each panel for lifting and handling the panel into place as well as serving as a fastening means for a top edge bridging member that spans adjacent panels.

A further object of the present invention is to provide a wall structure of the class described with a weatherproofed triangular tongue and groove connection between adjacent panels.

SUMMARY OF THE INVENTION

The present invention provides a wall structure formed of a plurality of pre-cast reinforced concrete building panels each having at least one integral stud member extending upwardly from the top edge thereof. The bottom edge of each panel is seated in a precision-formed groove that is formed in a supporting member such as the footing of the building foundation. The vertical side edges of adjacent panels have mating surfaces that form an interlocking connection therebetween. Sealing means are added to the panel joints for weatherproofing the wall structure. The top edge of each panel is fitted with a bridging member that spans adjacent panels and is attached to both by means of the integral stud members.

BRIEF DESCRIPTION OF THE DRAWINGS

This invention will be better understood from the following description taken in conjunction with the accompanying drawings and its scope will be pointed out in the appended claims.

FIG. 5 is a left side elevational view similar to that of FIG. 3 except the bottom edge of the panel is shown supported in a channel member bolted to the footing rather than in a groove formed in the footing as in FIG. 3.

FIG. 6 is a fragmentary perspective view of a section of wall where one of the 4'×8' building panels has been replaced by a door and a door frame. A header is suspended from an overhead bridging member to close the space from the top edge of the wall to the top edge of the door frame.

DESCRIPTION OF THE PREFERRED EMBODIMENTS

Figure 1:
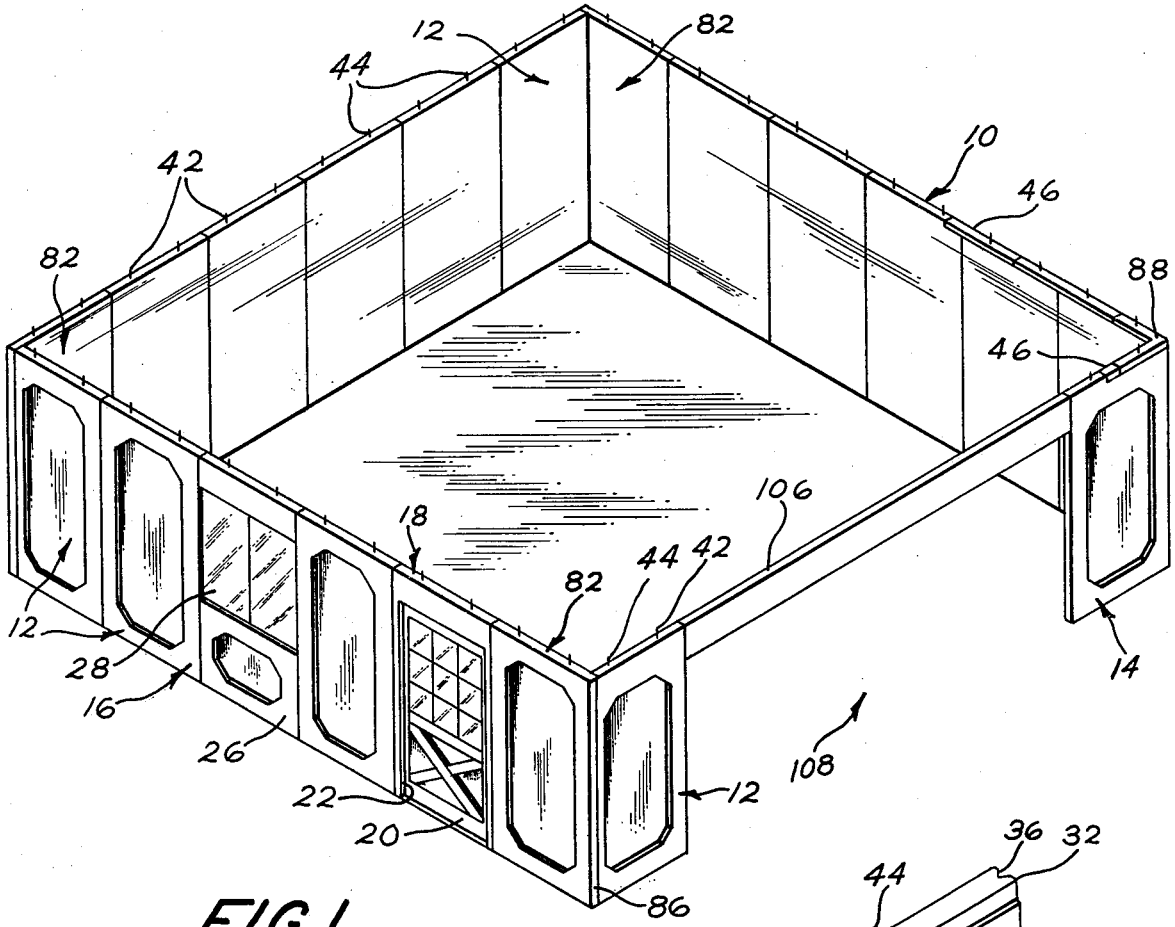
FIG. 1 is a perspective view of the wall structure of a two-car garage embodying the features of the present invention.

Turning now to a consideration of the drawings and, in particular, to the overall perspective view of a two-car garage 10 having preformed structural walls embodying the present invention, there is shown pre-cast reinforced concrete panels 12 which are assembled together to form the four walls of the building. The preferred dimensions of the panels are 4' wide, 8' high and 3" thick; but, of course, other dimensions may be adopted to suit the need without departing from the scope of the present invention.

The front wall 14 has but two panels 12. The remainder of the front wall would be formed by an overhead garage door, which is not shown. The side wall 16 has six panels 12, where one special panel 18 includes a built-in door 20 and door frame 22. A second special panel 26 includes a built-in window 28. There is almost no limit to the various designs of panels that may be devised. The main concept is that it is easier and less expensive to build various components into the concrete panel during the molding of the concrete panels, rather than adding them later at the job site. Such components may be windows, doors, electrical wiring boxes and conduit and plumbing elements such as pipes or other fixtures.

Figure 2:
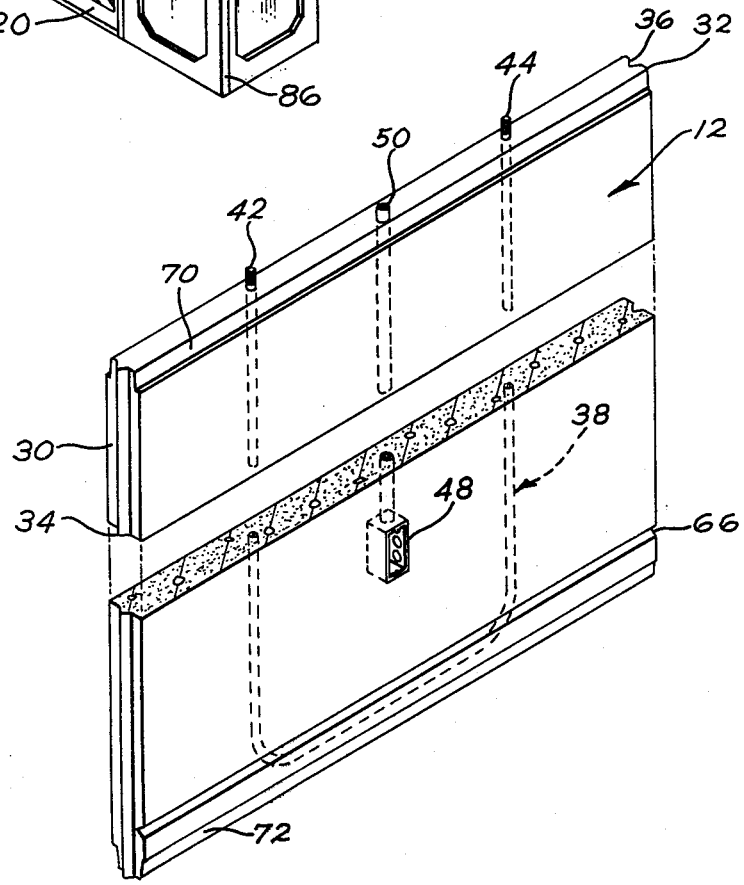
FIG. 2 is a perspective view of a single pre-cast reinforced concrete building panel embodying the present invention.

For a better understanding of a typical building panel 12, attention is directed to FIG. 2. The opposite side edges 30 and 32 are provided with mating vertical tongue 34 and groove 36 formations, respectively. The tongue 34 has a triangular transverse cross-section, and the groove 36 has a similar cross-section so when two adjacent panels are in butting engagement, the tongue of one panel is captured in the groove of the next panel. A weatherproof sealant or caulking would be applied in the tongue 34 and groove 36 connection to seal these joints against movement and weather to make up for any clearance between the mating parts.

Figure 3:
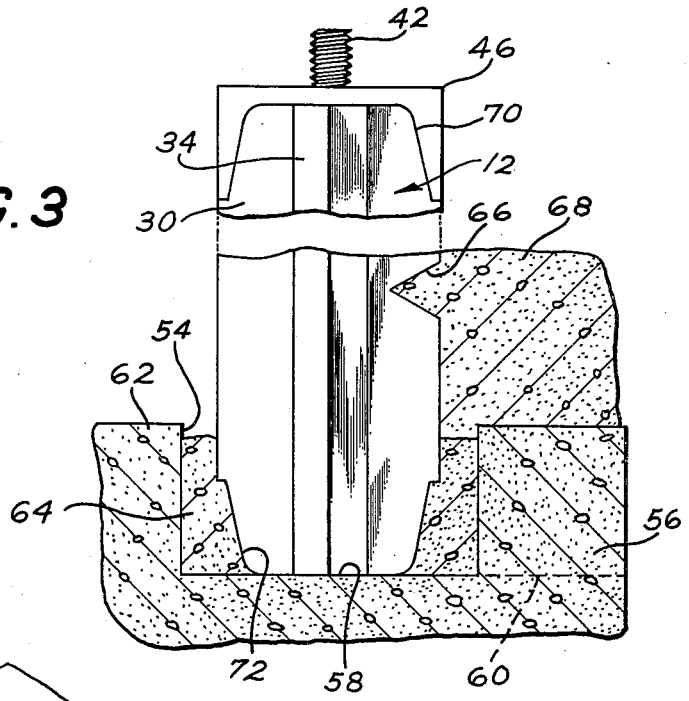
FIG. 3 is a left side elevational view of the concrete building panel shown in FIG. 2, with the bottom edge of the panel supported in a groove in the footing, and with a channel-shaped bridging member forming a cap over the top edge of the panel.

The panel 12 is reinforced by a large U-shaped rod 38 that is embedded therein. The two ends of the rod extend up out of the top edge of the panel as two threaded stud members 42 and 44. These stud members serve two functions, namely as handles for use in lifting the heavy panels, and also as fastening means with bridging members 46, as is seen in FIG. 3, that span two adjacent panels and tie them together. When the stud members are used as handles, a steel bar or beam (not shown) would be bolted to them, and a crane would engage the steel bar for lifting and moving the panel about.

Notice an electrical box 48 is shown embedded in the panel 12, and it is often on the interior surface of the panel. An electrical conduit 50 is joined to the box, and it extends upwardly through the top edge of the panel. After the four walls of the building 10 are assembled together, the electrician may feed electrical wires through the various conduits for wiring the building with an electrical service. These electrical components 48 and 50 are by way of example only. Other modifications may include water or gas pipes, drains, faucets, heaters, cabinets and the like.

Figure 10:
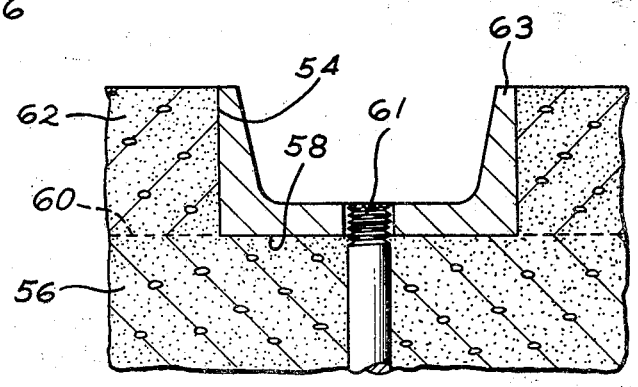
FIG. 10 illustrates the channel member after setting of the concrete with the nut removed and with the bolt broken off in a level, horizontal plane at the bottom of the bight of the channel member.

Now turning to a consideration of the side elevational view of the panel 12 of FIG. 3, the panel 12 is shown supported in a groove 54 in the footing 56 of the foundation of the building. The straightness and level of the base 58 of this groove 54 are critical factors in the success of this preformed structural wall invention, because the panel is seated on this base 58. One successful procedure has been to pour a partial footing up to the line 60 that coincides with the base line 58, and at the same time install spaced, vertical threaded rods 61 (See FIGS. 7 through 10) in the footing 56 extending up from the base line 58. Then install a channel member 63 of the overall size of the groove 54, on the order of 2" by 4", on the threaded rods. By the use of adjusting nuts 65 on the rods the channel member may be leveled properly. Then the top portion 62 of the footing 56 is poured around the channel member. As illustrated in FIG. 10, the channel member 63 may be maintained in place and the threaded rod 61 broken off even with the bight thereof. In this case, the bight of the channel member forms the horizontal groove 54 for a support of the concrete panel 18. In another embodiment, as illustrated in FIG. 3, the nut 65 is removed and the channel member is removed before the top portion 62 of the footing 56 sets permanently. In either event, the threaded bolts 61 and nuts 65 prevent the channel member from "floating" when the additional cement 62 is poured. Before this section of concrete sets permanently, the channel member would be removed, leaving the straight and level groove 54. Then the threaded rods would be broken off. After the panel is positioned in the groove, a suitable sealant 64 would be applied in the groove 54 around the lower end of the panel for fixing the panel in place and for weatherproofing the joint. A horizontal longitudinal groove 66 is formed on the interior side of the panel 12 near the bottom, so that when the floor slab 68 is poured it will key into this groove 66 for joining the floor with the wall panels 12.

Notice in FIG. 3 that the top edge of the panel 12 is tapered at 70 for receiving in a close fit the inverted channel-shaped briding member 46. A similar taper 72 is applied to the bottom edge of the panel so that a channel member 74 may be substituted for the groove 54 for aligning and supporting the panels, as is seen in FIG. 5. Suitable anchor bolts 76 are embedded in the footing 56 and engage a side flange 78 of the channel member 74 for holding the channel 74 rigid during the placement of the panels 12 down into the channel member.

Figure 4:
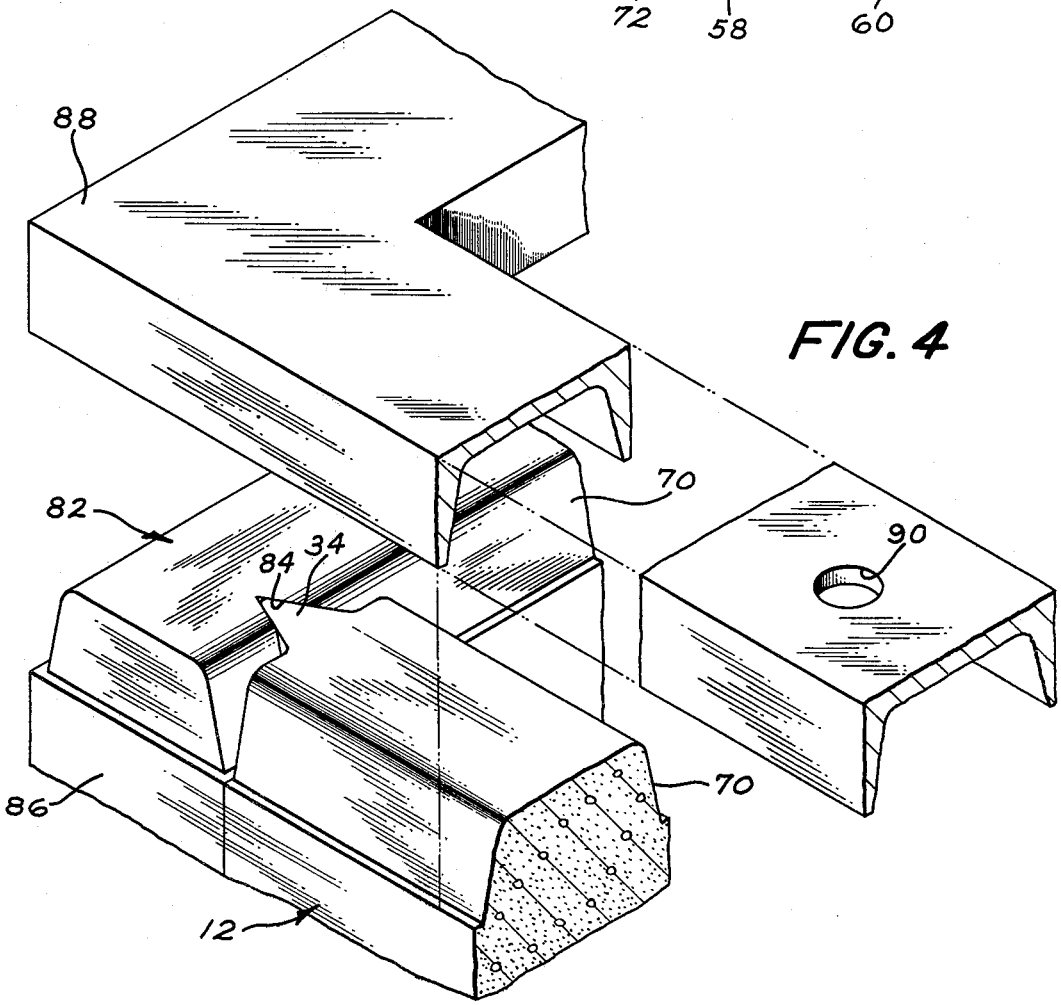
FIG. 4 is a fragmentary perspective view of a corner formation showing two panels with a tongue and groove connection therebetween, and an angular bridging member formed of an inverted channel member.
Figure 7:
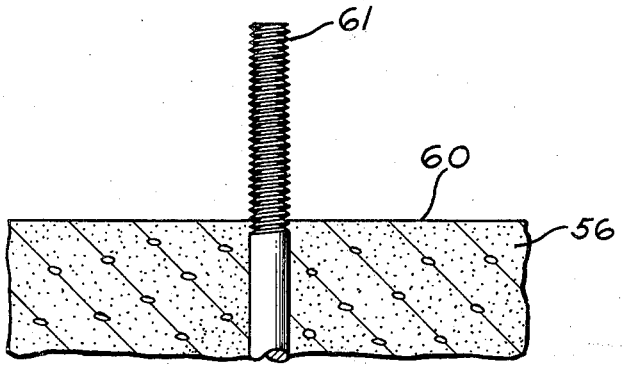
FIG. 7 illustrates a frangible threaded bolt set in a partial footing of concrete preparatory to the formation of a level groove in the footing.
Figure 8:
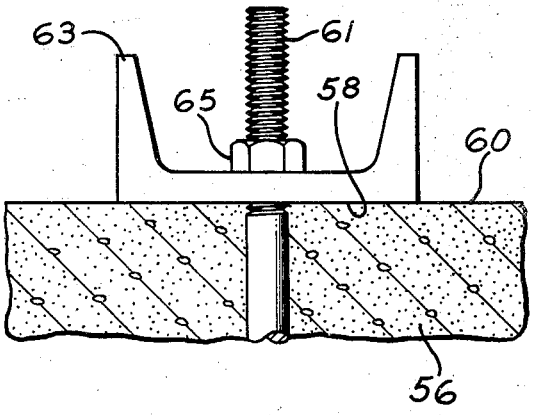
FIG. 8 illustrates the placement of a channel member over the threaded bolt and the addition of a nut to the bolt to hold the channel member in position.
Figure 9:
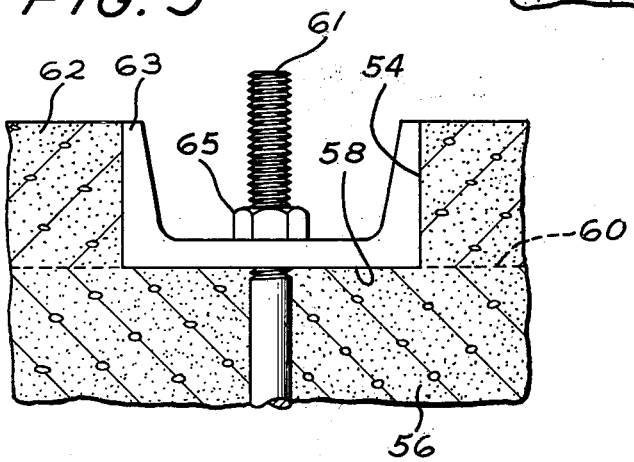
FIG. 9 illustrates additional cement poured around the channel member, held in place by said nut and bolt.

FIG. 4 is a perspective view of a corner joint. There is a special corner panel 82 having a side groove 84 on its interior surface near one edge for receiving the tongue 34 of the adjacent panel 12. Thus, the panel 82 has a plain side edge 86. An angular bridging member 88 is adapted to fit over the tapered top edge 70 of the panels 12 and 82 in a manner similar to the bridging member 46. Two holes 90 are predrilled in the bridging member for receiving the stud members 42 and 44 threrethrough.

FIG. 6 shows a modification of a door 94 and door frame 96 which are large enough to replace a complete building panel 12. A concrete header 98 is used to fill the space from the top edge of the wall to the top edge of the door frame 96. The header has a tongue 34' along one side edge and a groove 36' along the other side edge for mating with adjacent panels 12. The header 98 is suspended from an overhead bridging member 100 by means of a U-shaped reinforcing rod 102. A similar suspension arrangement could be used to form a concrete beam 106 above the garage door opening 108, as seen in FIG. 1. This beam may or may not have steel channel members on the top and bottom edges thereof.

Having described above a novel preformed structural wall formed of pre-cast reinforced concrete building panels, it will readily be apparent to those skilled in this art that these building panels may be used in many different combinations for use in many different building styles and configurations. They may be used in one story and multi-story buildings, in residential or commercial buildings, all without the use of additional framing. If the interior wall surface is to be furred out for providing insulation or a finished dry wall appearance, furring nails (not shown) may be embedded in the panel 12. Of course, other metal reinforcements could be employed within the panels depending upon the loading to be carried by the wall structure. Also, the integral stud members 42 and 44 could be separate from the panel reinforcement means. In addition, the groove 54 or channel 74 could be formed in or on the floor slab 68 rather than in the footing 56. Moreover, the floor slab could be poured at the same time as the footings are poured. The bridging members 46 and 88 could be formed of wooden 2"×4"s rather than steel channel members. Or the 2"×4"s could be assembled over the steel channels 46 and 88, and angle straps or clamps (not shown) could be assembled to the 2"×4"s for engaging and holding the ceiling joists (also not shown). Also the surface finish of the panels may include decorative patterns to enhance the appearance.

It should also be understood that the cost of labor in erecting this preformed wall structure is greatly reduced from the cost of labor using conventional cinder or cement blocks in staggered relation to one another, one on top of the other, in horizontal tiers, and held in position by conventional mortar. Such walls require scaffolding, the mixture and carrying of mortar, and the carrying and placement of the individual blocks themselves.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. A preformed structural wall including at least two modular sections disposed in edgewise butting relationship, each section having:
   a. a pre-cast reinforced concrete panel of generally rectangular shape with at least two integral reinforcing stud members extending upwardly from the top edge thereof;
   b. the vertical side edges of adjacent panels having mating surfaces forming an interlocking connection therebetween, and sealing means present in the connection for waterproffing the joint;
   c. the bottom edge of each panel being adapted to be seated in an elongated groove of a supporting member so as to align the panels, and sealing means present in the groove for waterproofing the joint and supporting the panel;
   d. an elongated bridging member that spans only two adjacent panels and is attached to both panels by means of the integral stud members, so as to be in abutment with an adjacent bridging member.

2. The invention of claim 1 wherein each panel is furnished with a large U-shaped reinforcing rod which extends out of the top edge of the panel and terminates as the said two integral stud members.

3. The invention of claim 1 wherein the said elongated groove of a supporting member is formed by a channel beam, and the said bridging members are formed of inverted channel beams which fit down over the top edge of two adjacent panels.

4. The invention of claim 1 wherein the said mating surfaces are triangular tongue and V-groove members.

5. The invention of claim 1 wherein the said structural wall includes a corner formation with one of the beforementioned pre-cast panels and a special panel having a vertical mating surface along one side of one of its planar surfaces for engaging with the mating surface on the vertical side edge of the adjacent corner panel, and a corner bridging member of angular configuration assembled over the top edge of the two adjacent panels of the corner formation and engaging one of the integral stud members at each end of the bridging member for holding them together.

6. The invention of claim 5 wherein the said bridging members are formed of inverted channel beams which fit down over the top edge of the panels.

7. The invention of claim 5 wherein the said mating surfaces are triangular tongue and V groove members.

8. The invention of claim 5 wherein at least some of the said pre-cast panels are furnished with window frames and some with door frames, and some of the panels are furnished with electrical wiring components all of which are integral therewith before erection on the site.

9. The invention of claim 1, wherein the elongated groove of a supporting member is an absolutely level groove along a longitudinal plane formed in the concrete footing by the following steps:

a. pouring a partial footing of concrete;
b. installing vertically threaded rods into said partially poured footing;
c. installing channel members over said threaded rods and in said partially set concrete of said partially poured footing;
d. pouring the remainder of said footing around said channel member;
e. leveling said channel member to an absolute level position in a horizontal plane by manipulation of nuts on said vertical threaded rods; and
f. breaking off the vertical threaded rods level with said plane.

10. The process of forming a perfectly level and straight elongated groove in a continuous footing forming the support of pre-cast building members in a structural wall which includes the steps of:

a. pouring a partial footing of concrete;
b. installing vertical threaded rods in spaced relation in said concrete;
c. installing channel members over said vertically threaded rods and into said partially set concrete footing;
d. pouring the remainder of said footing around said channel member;
e. leveling said channel member to a level position in a horizontal plane by manipulation of nuts on said vertically threaded rods;
f. thereafter breaking off the vertical threaded rods level with the surface of said level plane.

11. The invention of claims 9 or 10, the improvement which further comprises the step of removing said channel member before the poured concrete of said footing is absolutely set.

* * * * *